US006151817A

United States Patent [19]

Eiben

[11] Patent Number: 6,151,817

[45] Date of Patent: Nov. 28, 2000

[54] IRONING BOARD WITH SLEEVE BOARD

[76] Inventor: Joachim Eiben, Strassburger Allee 52, Wilhelmshaven, Germany, D-26389

[21] Appl. No.: 09/456,025

[22] Filed: Dec. 2, 1999

[30] Foreign Application Priority Data

Dec. 19, 1996 [DE] Germany ..... 196 52 915
Dec. 19, 1997 [DE] Germany ..... PCT/DE 97/02993

[51] Int. Cl.[7] ..... D06F 81/12; D06F 81/02

[52] U.S. Cl. ..... 38/135

[58] Field of Search ..... 38/104, 107, 135, 38/137, DIG. 1, DIG. 2, DIG. 3; 108/118, 120

[56] References Cited

U.S. PATENT DOCUMENTS

| | | | |
|---|---|---|---|
| 863,150 | 8/1907 | Busch et al. | 38/135 X |
| 2,923,077 | 2/1960 | Tipping | 38/104 |
| 3,245,161 | 4/1966 | Adiletta et al. | 38/104 |
| 3,324,584 | 6/1967 | Adiletta et al. | 38/140 |
| 3,698,110 | 10/1972 | Shettel | 38/107 |
| 5,016,367 | 5/1991 | Breen et al. | 38/104 X |

FOREIGN PATENT DOCUMENTS 29507401 9/1995 Germany .

*Primary Examiner*—Ismael Izaguirre
*Attorney, Agent, or Firm*—Cohen, Pontani, Lieberman & Pavane

[57] ABSTRACT

An ironing table having an ironing board which possesses at one end two sections extending side by side, approximately in one plane, specifically a clothes ironing section and a sleeve ironing section narrower than the latter, the two sections being separated from one another by a gap. The gap extends approximately to the height of the center of the ironing board, the clothes ironing section admittedly having the width of a conventional ironing board, so that the overall width of the ironing board in the region of the clothes ironing section and sleeve ironing section is greater than the width of a conventional ironing board. In addition, the longitudinal side of the ironing board assigned to the sleeve ironing section extends from approximately the center of the ironing board to the other end of the ironing board, so that the width of this end of the ironing board approximately corresponds to the width of the clothes ironing section, in other words to a conventional ironing board.

10 Claims, 3 Drawing Sheets

IRONING BOARD WITH SLEEVE BOARD

This is a continuation application under 35 U.S.C. §111 and 37 CFR §1.53 of international PCT application No. PCT/DE97/02993 which was filed on Dec. 19, 1997, published as publication No. WO 98/277259 on Jun. 25, 1998, and claims priority from German Application No. 196 52 915.8 filed Dec. 19, 1996.

BACKGROUND OF THE INVENTION

Field of the Invention

The invention relates to an ironing table having an ironing board.

The ironing board of an ironing table serves as a resting surface, for example, for items of clothing to be ironed. In order to make it possible to iron relatively narrow items of clothing, or narrower parts of items of clothing, such as for example shirt sleeves or trouser legs more easily, known ironing tables frequently have a separate sleeve ironing board with significantly reduced dimensions. This sleeve ironing board can, for example, be erected on the ironing board when it is needed and thus has to be assembled or dismantled additionally. In addition, free suspension of the items of clothing to be ironed below the sleeve ironing board is limited by the reduced structural height of the sleeve ironing board, as a result of which renewed creasing may occur within the item of clothing to be ironed during ironing.

In some known ironing tables, a sleeve ironing board, capable of being folded, swung (U.S. Pat. No. 5,016,367) or, as described in German reference DE 295 07 401 U1, inserted laterally into an ironing position is arranged on the ironing board, which is correspondingly costly.

In U.S. Pat. No. 3,324,584, an ironing board is described whose outer contour is essentially designed with parallel longitudinal sides, a longitudinal slit being made at one end of the ironing board so that a narrower sleeve ironing section is provided. As a result of the separation of a sleeve ironing section from the complete ironing board, an admittedly somewhat wider section than the ironing section additionally remains at the correspondingly divided end of the ironing board, which is of not insignificant length, but this can no longer be used sufficiently effectively as a clothes ironing section, being too narrow for this purpose. If large articles such as curtains or bedlinen are to be ironed on this known ironing board, with the single split end, it is necessary for this ironing work to be confined to the remaining, undivided part of the ironing board, since it is only on this that relatively large-area ironing is possible in depth as well as width. The known ironing board is, in this case, fixed on a generally standard folding subframe with two supporting legs that can be pivoted relative to one another.

SUMMARY OF THE INVENTION

The object of the invention is to improve an ironing table of the present above-mentioned generic type so that the ironing board retains a clothes ironing section of unaltered size and, in addition, possesses a sleeve ironing section of ideal availability.

This object is achieved by an ironing table having the features of claim 1.

The ironing board of the ironing table according to the invention is thus integrally formed from two ironing sections. The various items of clothing or other articles to be ironed, such as curtains, bedlinen or the like, can be ironed on the clothes ironing section of consistently greater width as on the conventional ironing board of a known ironing table.

The reason for this is that, according to the invention, the gap between the clothes ironing section and the narrow sleeve ironing section is designed to extend approximately to the height of the center of the ironing board, the clothes ironing section being approximately the width of a conventional ironing board, so that the overall width of the ironing board in the region of the clothes ironing section and sleeve ironing section is greater than the width of a conventional ironing board. In addition, the longitudinal side of the ironing board assigned to the sleeve ironing section extends from approximately the center of the ironing board to the other end of the ironing board, so that the width of this end of the ironing board approximately corresponds to the width of the clothes ironing section, in other words to a conventional ironing board.

A further advantage is that the ironing table of the present invention possesses a subframe formed from at least two support parts, the support parts being connected to one another on a pivot pin to be foldable like scissors and free folding ends of the support parts being capable of being set at different distances from one another by means of a steplessly longitudinally adjustable setting member. In this case the ironing board is removably arranged on the subframe and is capable of being placed thereon in a fixed position.

With the subframe provided, the ironing table according to the invention can be stably erected. The support parts are folded into an X-shaped position relative to one another which permits secure standing of the ironing table. The free folding ends of the support parts facing the ironing table or facing the standing surface are connected to one another by a longitudinally adjustable setting member. As a result of the longitudinal adjustability of this setting member, the distance between the free folding ends can be changed as desired. As a result of the changing of this distance, the folding position of the two support parts relative to one another is simultaneously changed, with the advantage that different heights of the ironing table can be set by selecting different folding positions of the two support parts.

The distance between the folding ends of the support parts can preferably be set by means of a steplessly longitudinally adjustable setting member. As a result, simultaneously and advantageously, the height of the ironing table can be steplessly set. The ironing table according to the invention, therefore, cannot merely be brought into different, fixed height steps as in the case of known ironing tables, but the height of the ironing table can also adopt any height between and outside these height steps. In particular, it is possible to set the ironing table according to the invention to a very low height so that, for example, older persons can also do ironing when seated.

In a further embodiment of the invention the setting member is a strap which can be brought into active connection with the free folding ends of the support parts and has a strap buckle for setting different strap lengths. Preferably, the strap is brought into active connection with the free folding ends of the support parts which face the ironing board, because these free folding ends are more accessible to the user of the ironing table. The strap, in order to bring about the active connection, may, for example, simply be passed around sections of the support parts in the region of the free folding ends and buckled to itself by means of the strap buckle to form a loop. This design of the setting member is very simple but especially practical. The width of the strap loop can be changed by actuating the strap buckle. The strap loop can be designed to be tighter or wider, the distance between the folding ends of the support parts being reduced or increased. In addition, when the ironing table is no longer in use and is to be put away in its position of non-use, the subframe can simply be folded together without it being necessary to make any adjustments to the setting member which is designed as a strap. The strap is loosely connected to the support parts in the non-use position. When the ironing table is used again, the subframe is simply brought into a folding position determined by the width of the strap loop, the strap loop still being available with the previous length setting. This means, advantageously, that the ironing table is always re-erected at a height which has proven advantageous for the user without any settings of the setting member being necessary for that purpose. The same advantage is achieved when the strap is not designed as a loop but, for example, comprises two belt lengths, each attached to one folding end, which can be connected to one another by means of the strap buckle to form overlaps of varying size of the ends of the lengths.

According to a further embodiment of the invention, members for placing the ironing board in a fixed position on the subframe are arranged on the side of the ironing board facing the sub frame. With the members provided for placement, the ironing board can be connected to the subframe for use. At the same time, these members make it possible to separate the ironing board from the subframe, which is particularly advantageous when only restricted space is available for the storage of the ironing table. This restricted space can be optimally used by the mutually separated components of the ironing table.

The members for placing the ironing board comprise hook-round rails preferably oriented parallel to the longitudinal extent of the ironing board. At the free folding ends, facing the ironing board, of at least one support part, projections are arranged behind which these hook-round rails can engage. As a result of the hook-round rails and the projections, an interlocking connection can advantageously be produced between the ironing board and the subframe. It is also made possible here for this connection to be varied regarding the position of the projections provided on the subframe within the hook-round rails arranged on the ironing board. The variation is brought about by means of different setting heights of the ironing table according to the invention. As a result of the design of the rails and their parallel orientation to the longitudinal extent, then, it is advantageously made possible for the ironing board to be connected to the subframe in an interlocking manner even with different setting heights of the ironing table.

In order to produce a positionally fixed connection between the ironing board and the subframe, in a further embodiment of the invention the members for placing the ironing board on the subframe comprise hooks which can be brought into interlocking connection with the free folding end, facing the ironing board, of a support part. While the connection between ironing board and subframe by means of the hook-round rails and projections is also designed to be positionally variable with regard to a displacement of the projections within the hook-round rails, the ironing board is fixedly connected to the subframe by means of the hooks which can be brought into interlocking connection with a folding end of a support part. The ironing board, in this case, is preferably displaced by means of the hook-round rails on the subframe to the point where these hooks are brought into an interlocking connection with the folding end of the support part.

To lock this interlocking connection, provision is made for a locking member for the hooks to be arranged at the folding end of the support part which is assignable to the hooks. The locking member may be designed, for example, as a clamp which secures the hooks. The clamp prevents the ironing board from becoming detached from the subframe during use as an ironing support. As a result of the release of the clamp, the ironing board can then be released once again from the subframe. The clamp thus serves to secure the fixed connection between the subframe and the ironing board. The support parts of the subframe are preferably designed as a support frame which allows secure standing of the ironing table.

BRIEF DESCRIPTION OF THE DRAWINGS

The invention is explained in detail below with reference to an embodiment in relation to the drawings, in which.

DETAILED DESCRIPTION OF THE PREFERRED EMBODIMENT

Figure 1:
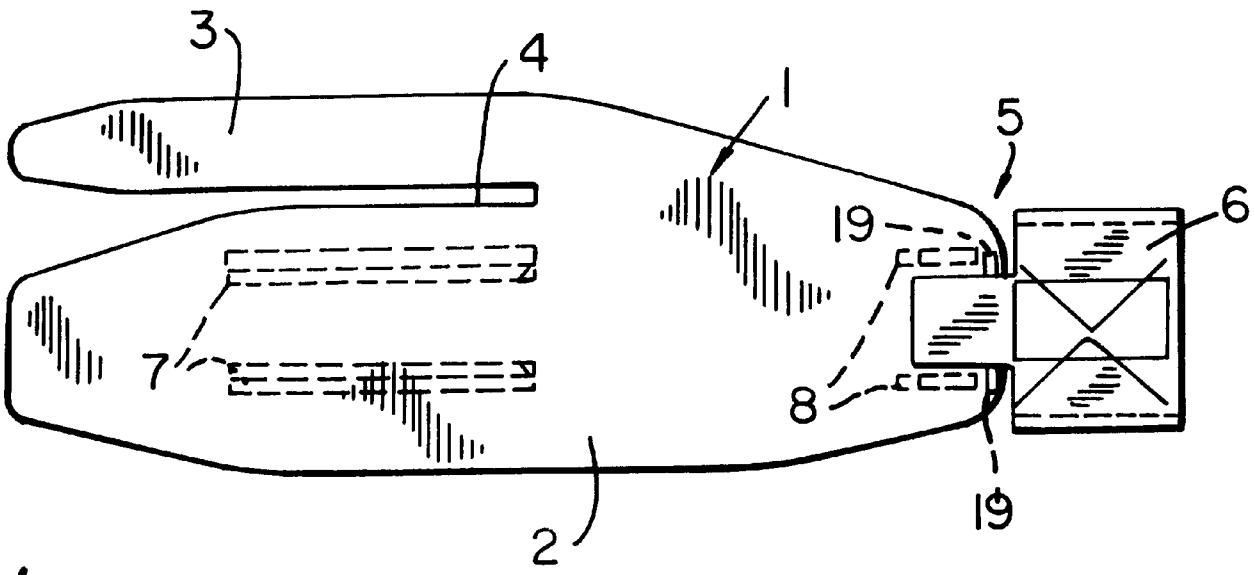
FIG. 1 shows a plan view of an ironing board of an ironing table according to the invention.

The ironing board 1 in FIG. 1 possesses a clothes ironing section 2 and sleeve ironing section 3 which is narrower than the clothes ironing section 2. The ironing board 1 is formed integrally in this case. The clothes ironing section 2 has a longitudinally extended, approximately spindle-shaped design. The sleeve ironing section 3 likewise has a longitudinally extended design. It is attached to a longitudinal edge 4 of the clothes ironing section 2 and does not project beyond the ends of the clothes ironing section 2. The transition from the clothes ironing section 2 to the sleeve ironing section 3 is continuously designed here at the outside edge of the ironing board 1 from the end 5 of the clothes ironing section 2. The two sections 2, 3 of the ironing board 1 are oriented parallel to one another.

A resting surface 6 for setting down an iron (not shown) s removably arranged at the end 5 of the clothes ironing section 2. Members for placing the ironing board 1 on a subframe in a fixed position are arranged on the underside of the ironing board 1 in the central region of the clothes ironing section 2. The members for placing the ironing board 1 comprise two hook-round rails 7 oriented parallel to the longitudinal extent of the ironing board 1 and two hooks 8 arranged approximately flush with the hook-round rails 7.

Figure 2:
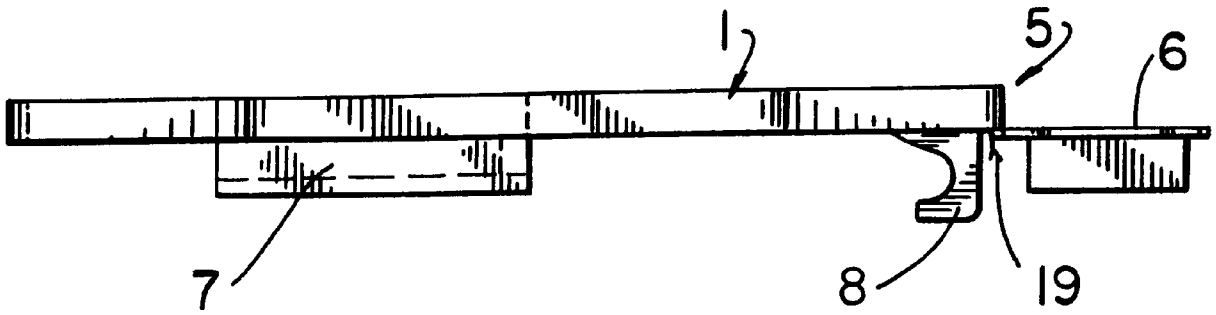
FIG. 2 shows a lateral view of the ironing board according to FIG. 1.

The arrangement of the rails 7 and the hooks 8 on the underside of the ironing board 1 is apparent from FIG. 2. Clips 19 are also arranged on the underside of the ironing board 1 between the hooks 8 and the resting surface 6 for an iron.

Figure 3:
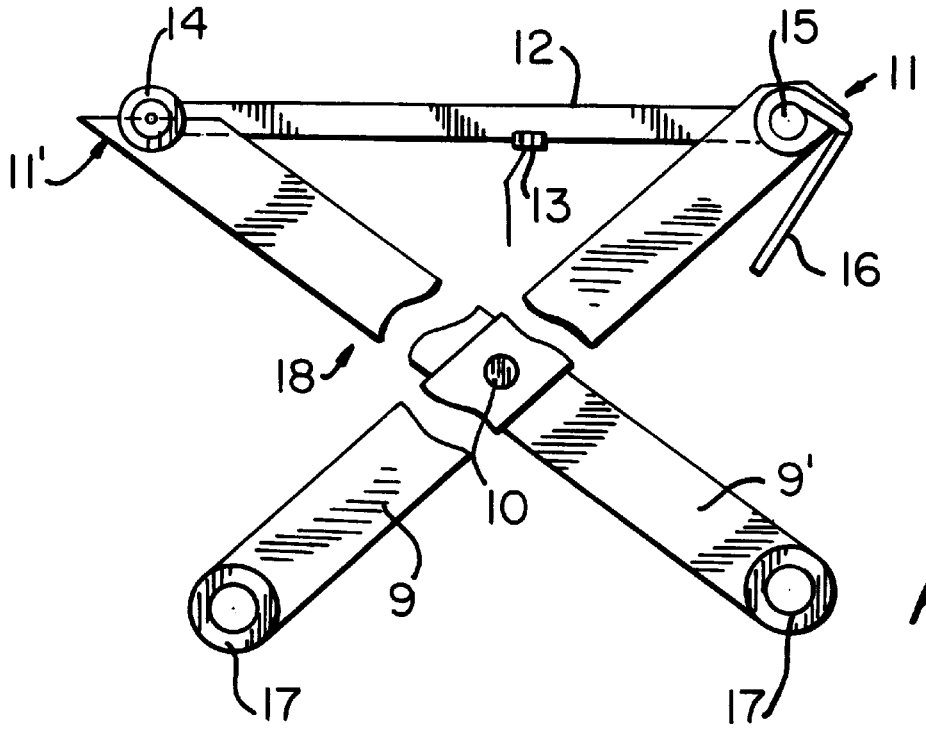
FIG. 3 shows a lateral view of a subframe of an ironing table according to the invention.

The subframe 18 of the ironing table in FIG. 3 comprises two support parts which are designed as support frames 9, 9'. The support frames 9, 9' are designed essentially identically to one another and are connected to one another approximately in the region of their central length on a pivot pin 10 to be foldable like scissors. The two upper free folding ends 11, 11' of the support frames 9, 9' are connected to one another by means of a setting member and brought to a distance apart from one another. The setting member designed as a strap 12 with a strap buckle 13. The strap 12 is buckled to itself as a strap loop. The strap buckle 13 permits various length settings of the strap loop formed by the strap 12. Projections 14 are arranged at the free folding end 11' of the support frame 9' and are designed as rollers. A locking member designed as a clamp 16 is pivotally arranged on a pivot pin 15 at the free folding end 11 of the support frame 9. Feet 17 are arranged at the lower free ends of the support frames 9, 9' opposite the free folding ends 11, 11', by means of which feet 17 the subframe 18 of the ironing table is erected in a manner secure against tilting. Lockable wheels can, for example, be provided as feet 17.

Figure 4:
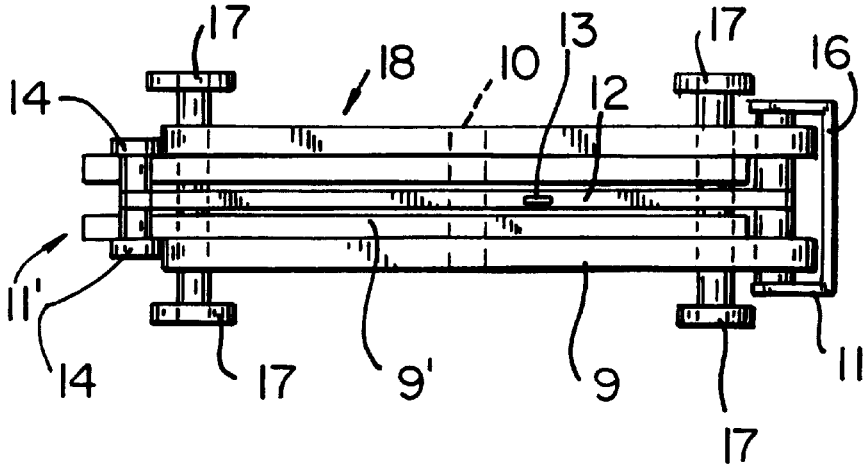
FIG. 4 shows a plan view of the subframe according to FIG. 3.

FIG. 4 shows the design of the support frames 9, 9'. The frame sections of the support frame 9' are arranged within the frame sections of the support frame 9 in this case. The strap 12 is passed around mutually parallel frame sections of the support frames 9, 9' in the region of the folding ends 11, 11'.

Figure 5:
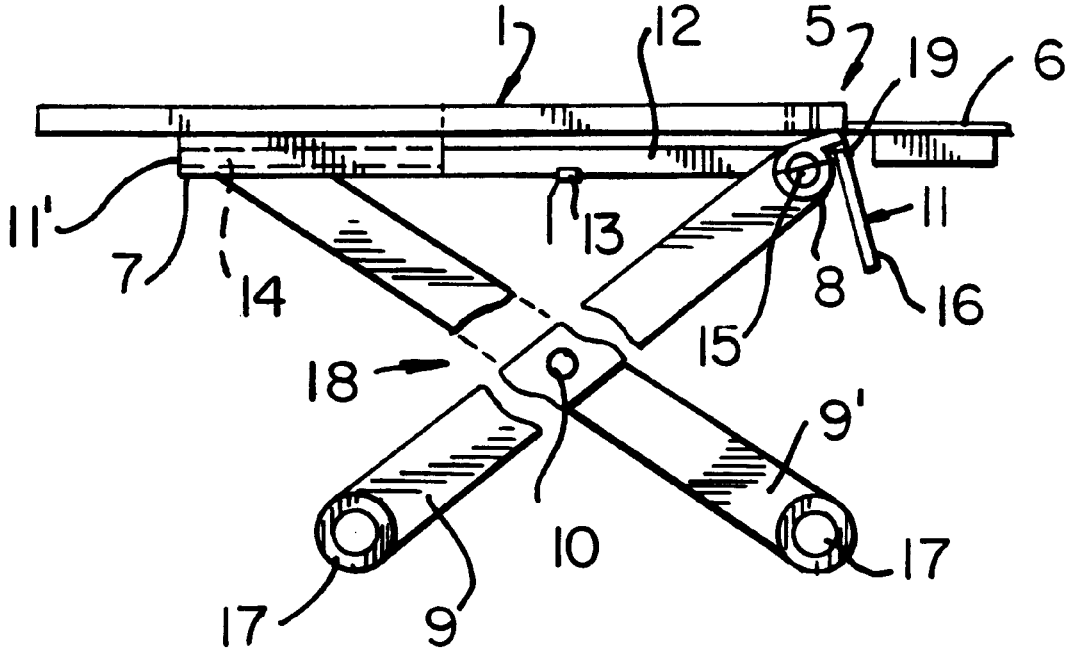
FIG. 5 shows a lateral view of an ironing table according to the invention comprising an ironing board according to FIGS. 1 and 2 and a subframe according to FIGS. 3 and 4.

FIG. 5 shows the ironing table according to the invention in a state in which the ironing board 1 is connected to the subframe 18. The members for placing the ironing board 1, arranged on the underside of the ironing board 1, are brought into connection with the upper free folding ends 11, 11' of the support frames 9, 9'. The hook-round rails 7 in this case engage behind the projections 14 arranged on the upper free end 11' of the support frame 9'. The hooks 8 on the underside of the ironing board 1 are brought into interlocking connection with the upper free end 11 of the support frame 9. The clamp 16 serves in this arrangement to secure this interlocking connection, the clamp 16 being clipped into the clips 19 arranged on the underside of the ironing board 1 (see FIGS. 1 and 2).

The projections 14 can be received within the hookround rails 7 in various sections of the longitudinal extent of the rails. These various sections can be produced by changing the length of the loop of the strap 12, the distance between the upper free folding ends 11, 11' of the support frames 9, 9' being changed by changing, in this case especially shortening, the length. Changing this distance between the upper folding ends 11, 11', however, simultaneously effects a change in the height of the subframe 18. The ironing table can thus be set to various heights by changing the length of the loop formed by the strap 12, this setting taking place steplessly. To put away the ironing table in a non-use position, the ironing board 1 can be separated from the subframe 18.

What is claimed is:

1. An ironing table comprising an ironing board which possesses, at one end, two sections extending side by side substantially in one plane, a first one of the sections being narrower than a second one of the sections, the sections being separated from one another by a gap that extends substantially to a center of the ironing board, the first and the second sections each having a width so that an overall width of the ironing board in a region where the second section and first section are joined is greater than a width of a conventional ironing board, a longitudinal side of the ironing board assigned to the first section extending from approximately the center of the ironing board to the one end of the ironing board so that the width of the end of the ironing board approximately corresponds to the width of the second section.

2. An ironing table as defined in claim 1, and further comprising a subframe having at least two support parts connected to one another on a pivot pin so as to be foldable in a scissor-like manner, the support parts having upper ends, and still further comprising a longitudinally adjustable setting member for steplessly setting the upper ends of the support parts at variable distances from one another, the ironing board being removably arranged on the subframe and being capable of being placed thereon in a fixed position.

3. An ironing table as defined in claim 2, wherein the setting member is a strap which cain be brought into active connection with the upper ends of the support parts and has a strap buckle for setting different strap lengths.

4. An ironing table as defined in claim 2, and further comprising means for placing the ironing board in a fixed position on the subframe, the means for placing the ironing board in a fixed position being arranged on an underside of the ironing board facing the subframe.

5. An ironing table as defined in claim 4, wherein the means for placing the ironing board in a fixed position includes hook-round rails mounted on the underside of the ironing board so as to interact with projections at the upper end of at least one of the support parts so that the hook-round rails engage behind the projections, the placing means further including hooks provided on the underside of the ironing board which can be brought into interlocking connection with the upper end of another one of the support parts.

6. An ironing table as defined in claim 5, wherein the hook-round rails are mounted to the ironing board so as to extend parallel to a longitudinal axis of the ironing board.

7. An ironing table as defined in claim 5, and further comprising a locking member arranged at the upper end of the support part which is engagable with the hooks of the ironing board.

8. An ironing table as defined in claim 7, wherein the locking member is a clamp which secures the hooks.

9. An ironing table as defined in claim 8, and further comprising clips arranged on the underside of the ironing board.

10. An ironing table as defined in claim 2, wherein the support parts are configured as support frames.

* * * * *